US008104632B2

(12) United States Patent
Sasaki et al.

(10) Patent No.: US 8,104,632 B2
(45) Date of Patent: Jan. 31, 2012

(54) SYNTHETIC RESIN BOTTLE HAVING A CONSTRICTED PORTION WITH INTERMITTENT LATERAL GROOVES

(75) Inventors: Masaaki Sasaki, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 449 days.

(21) Appl. No.: 12/308,578

(22) PCT Filed: Jun. 5, 2007

(86) PCT No.: PCT/JP2007/061380
§ 371 (c)(1),
(2), (4) Date: Dec. 18, 2008

(87) PCT Pub. No.: WO2008/001585
PCT Pub. Date: Jan. 3, 2008

(65) Prior Publication Data

US 2009/0294400 A1 Dec. 3, 2009

(30) Foreign Application Priority Data

Jun. 30, 2006 (JP) ..... 2006-182754

(51) Int. Cl.
*B65D 1/02* (2006.01)
*B65D 1/42* (2006.01)

(52) U.S. Cl. ..... 215/381; 215/382; 215/384; 220/672; 220/675

(58) Field of Classification Search ..... 215/379, 215/381–384, 398, 900; 220/669, 675, 675 T, 220/672, 771
See application file for complete search history.

(56) References Cited

U.S. PATENT DOCUMENTS 5,224,614 A * 7/1993 Bono et al. ..... 215/384
6,257,433 B1 * 7/2001 Ogg et al. ..... 215/381
6,273,282 B1 * 8/2001 Ogg et al. ..... 215/381
D528,427 S * 9/2006 Sasaki et al. ..... D9/541
(Continued)

FOREIGN PATENT DOCUMENTS

JP U-7-6111 1/1995
(Continued)

OTHER PUBLICATIONS

May 31, 2011 Office Action issued in Japanese Patent Application No. 2006-182754 (with translation).

*Primary Examiner* — Sue Weaver
(74) *Attorney, Agent, or Firm* — Oliff & Berridge, PLC

(57) ABSTRACT

There is provided a synthetic resin bottle having high commercial value, which prevents plastic deformation accompanied with buckling. The invention provides a PET bottle comprising a body portion connected to a mouth portion via a shoulder portion, and a constricted portion provided on the body portion and looping along the circumferential direction. The body portion comprises a front wall and a back wall which face to each other, a left sidewall and a right sidewall which face to each other, and connecting portion which respectively join the walls. The cross section of the body portion along the circumferential direction a generally polygonal outer profile. The constricted portion comprises left lateral grooves extending from the left sidewall at least to the connecting portion along the circumferential direction, right lateral grooves extending from the right sidewall at least to the connecting portion along the circumferential direction and intermittent portions formed by spacing apart adjacent terminal ends of the lateral grooves.

7 Claims, 4 Drawing Sheets

U.S. PATENT DOCUMENTS

2003/0136754 A1 * 7/2003 Bourque et al. ..... 215/384

FOREIGN PATENT DOCUMENTS

JP A-7-40953 2/1995
JP A-11-180427 7/1999
JP A-11-236022 8/1999
JP A-2003-104347 4/2003
JP A-2004-1847 1/2004
JP A-2005-306455 11/2005
WO WO 2005100199 A1 * 10/2005

* cited by examiner

SYNTHETIC RESIN BOTTLE HAVING A CONSTRICTED PORTION WITH INTERMITTENT LATERAL GROOVES

TECHNICAL FIELD

The present invention relates to a synthetic resin bottle having high commercial value, which prevents plastic deformation accompanied with buckling.

RELATED ART

Some synthetic resin bottles, in view of the usability, have a body portion connected to a mouth portion via a shoulder portion, and a constricted portion which is provided on the body portion and loops along the circumferential direction to serve as a gripping portion. It has been already known that, in view of deformation caused by a grip of a user, an annular rib is formed in the constricted portion to reinforce the constricted portion (see, for example, JP2004-1847A).

DISCLOSURE OF THE INVENTION

Such conventional bottles show certain effects against stress concentration resulting from the grip at the constricted portion. However, the annular rib is not necessarily effective against buckling at the constricted portion caused by a load applied along a bottle axis extending from the mouth portion to a bottom portion. Therefore, there has been a problem that the plastic deformation of the constricted portion due to buckling deteriorates the appearance of the bottle, reducing the commercial value.

It is therefore an object to be achieved by the present invention to provide a synthetic resin bottle having high commercial value capable of preventing plastic deformation accompanied with buckling.

The invention provides a synthetic resin bottle comprising a body portion connected to a mouth portion via a shoulder portion, and at least one constricted portion provided on the body portion and looping along the circumferential direction, characterized in that the body portion comprises a front wall and a back wall which face to each other, a left sidewall and a right sidewall which face to each other, and connecting portions which respectively join the walls; the cross section of the body portion along the circumferential direction has a generally polygonal outer profile; the constricted portion comprises a left lateral groove extending from the left sidewall at least to the connecting portion along the circumferential direction, a right lateral groove extending from the right sidewall at least to the connecting portion along the circumferential direction and intermittent portions formed by spacing apart adjacent terminal ends of the lateral grooves.

In the invention, the terminal ends of the lateral grooves preferably reach the front wall and the back wall.

In the invention, it is preferable that the body portion has a generally rectangular cross section in which the front and back walls are its longer sides, the left and right sidewalls are its shorter sides, and the connecting portions are curves. It is noted that the outer profile of the body portion in the cross section along the circumferential direction can be modified appropriately according to the shape of the connecting portion.

In the invention, it is preferable that the constricted portion comprises a strip-like portion looping along the circumferential direction and a slope portion connected to the strip-like portion and expanding outward toward the bottom portion, wherein the strip-like portion and the slope portion are provided with the lateral grooves.

In the invention, furthermore, an area adjacent to the constricted portion is preferably provided with a supplemental lateral groove which is longer than the above lateral groove.

In the invention, it is preferable that the body portion is provided with a plurality of annular grooves and a pressure-reduction absorbing panel which extends between the annular groove closest to the constricted portion to the area of the annular groove farthest from the constricted portion, and that the pressure-reduction absorbing panel is located outward of the bottle than the bottom of the annular groove which intersects with the pressure-reduction absorbing panel, and that the annular grooves are recessed inward of the bottle at areas where the annular grooves intersect with the pressure-reduction absorbing panel.

According to the invention, the cross section of the constricted portion along the circumferential direction has a polygonal outer profile and the left and right sidewalls of the constricted portion are provided with the left and right lateral grooves, respectively, extending at least to the connecting portions along the circumferential direction, so that the stress concentration at the constricted portion caused by the load applied along the bottle axis is dispersed to, thereby, suppress occurrence of the buckling at the constricted portion.

In addition, according to the invention, the left and right lateral grooves provided at the constricted portion function are arranged so that the terminal ends thereof are mutually spaced apart and the lateral grooves are not annular grooves looping entire circumference, so that the lateral grooves serve as cushions and thus secure a large allowance for flexural deformation. That is, the left and right lateral grooves provided at the constricted portion generate restoring force against buckling deformation by stress applied along the bottle axis, which prevents plastic deformation of the constricted portion due to buckling.

Therefore, according to the present invention, it is possible to provide a synthetic resin bottle having high commercial value, which prevents plastic deformation accompanied with buckling.

REFERENCE SYMBOLS

Figure 1:
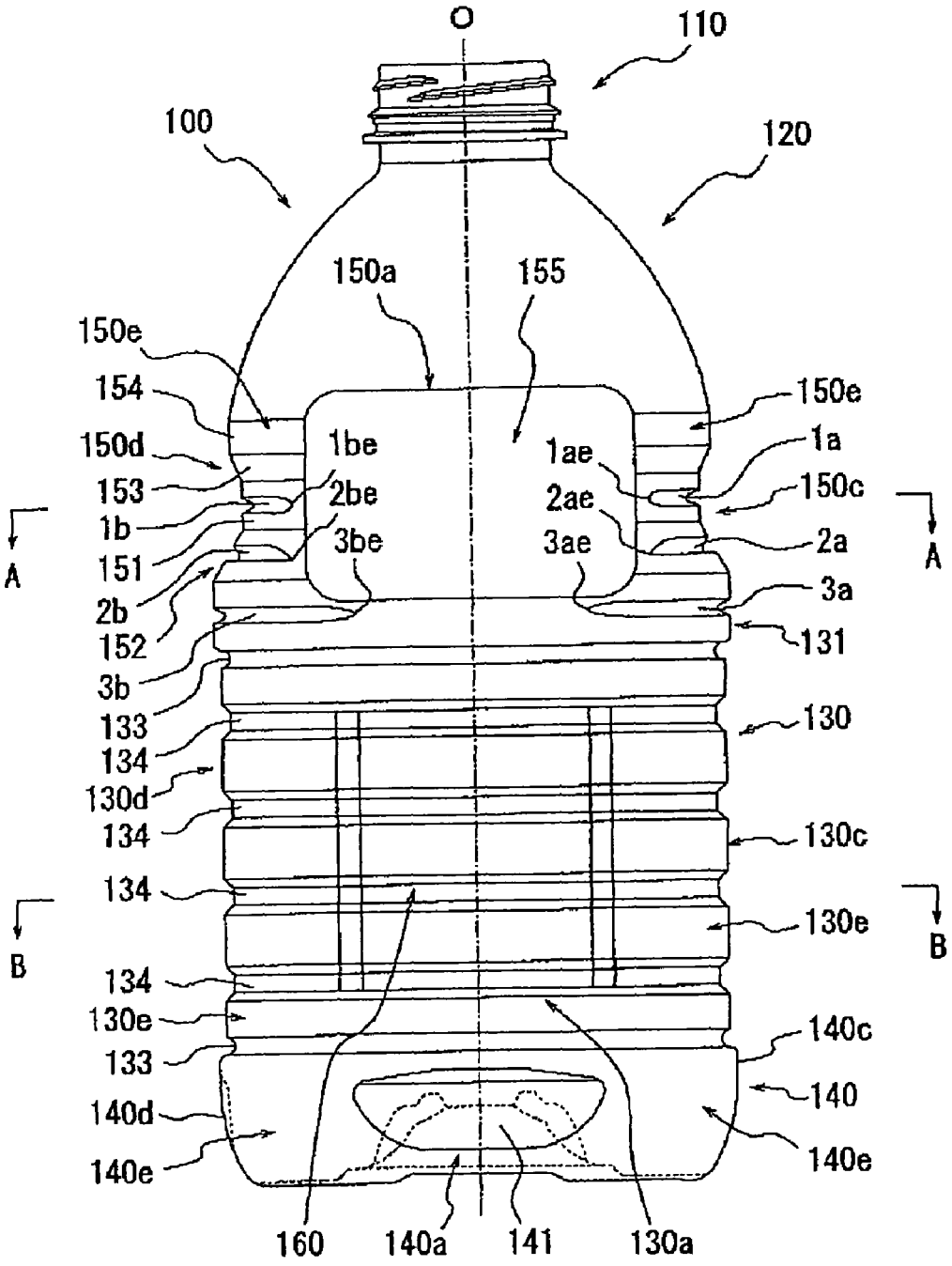
FIG. 1 is a front view of the synthetic resin bottle of the invention.

1*a* left lateral groove
1*b* right lateral groove
2*a* left lateral groove
2*b* right lateral groove
3*a* left supplemental lateral groove
3*b* right supplemental lateral groove
100 PET bottle (synthetic resin bottle)
110 mouth portion
120 shoulder portion

130 body portion
130*a* front wall
130*b* back wall
130*c* left sidewall
130*d* right sidewall
130*e* connecting portion
131 bulging portion
132 stepping portion
133 circumferential groove
134 annular groove
140 bottom portion
140*a* front wall
140*b* back wall
140*c* left sidewall
140*d* right sidewall
150 constricted portion
150*a* front wall
150*b* back wall
150*c* left sidewall
150*d* right sidewall
151 strip-like portion
152 bottom slope portion
153 shoulder slope portion
154 connecting portion
155 functional portion
160 pressure-reduction absorbing panel

BEST MODE FOR CARRYING OUT THE INVENTION

A preferred embodiment will be described with reference to the accompanying drawings.

Figure 2:
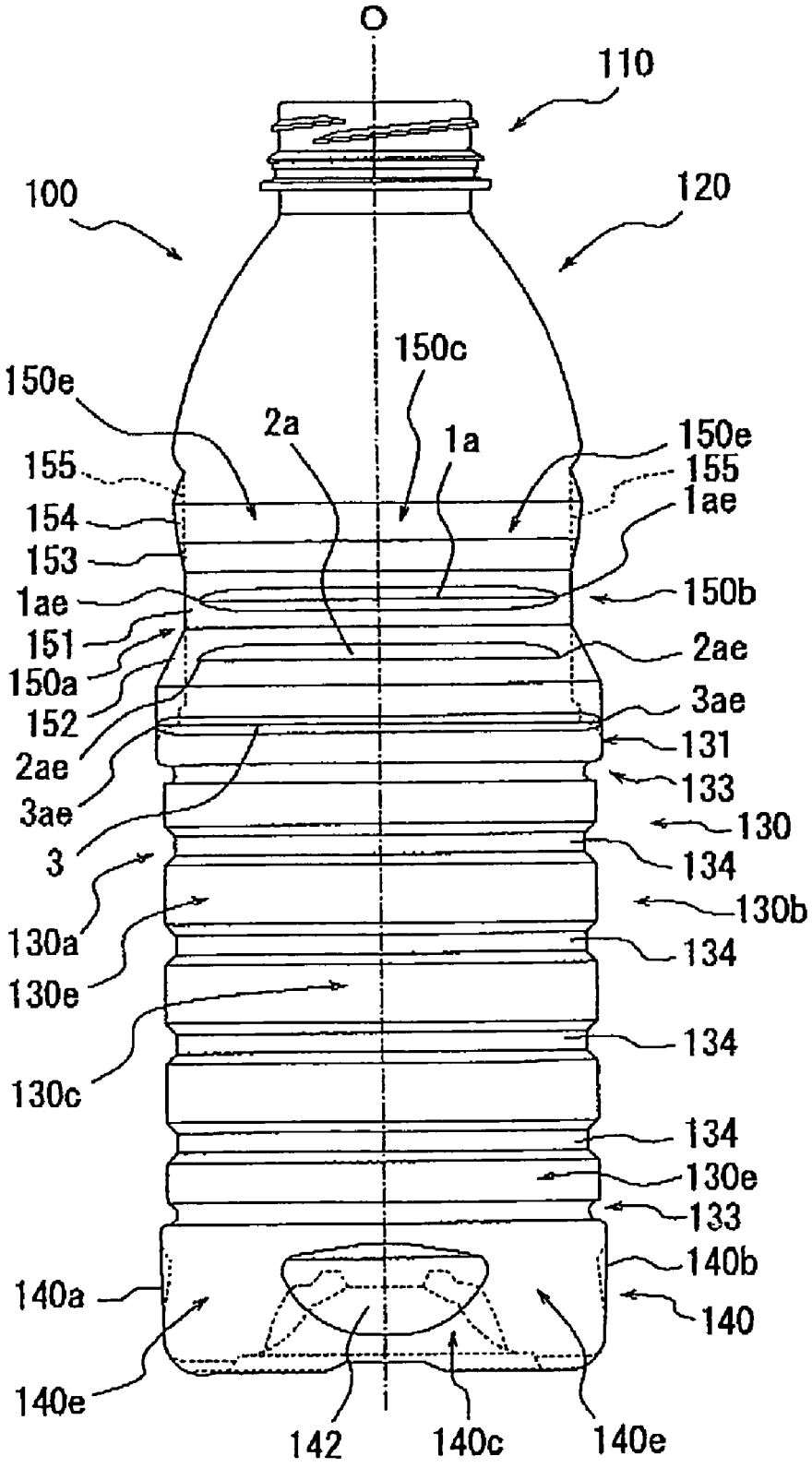
FIG. 2 is a side view of the synthetic resin bottle shown in FIG. 1.
Figure 3A:
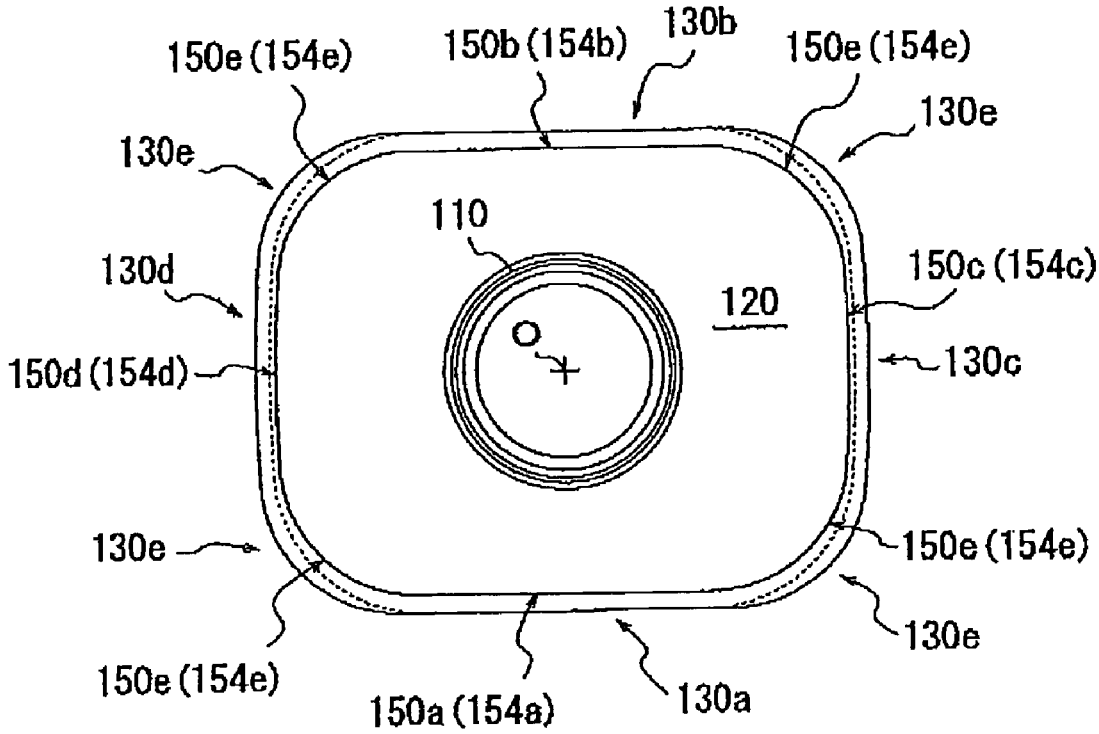
FIG. 3*a* is a top view of the synthetic resin bottle shown in FIG. 1.
Figure 3B:
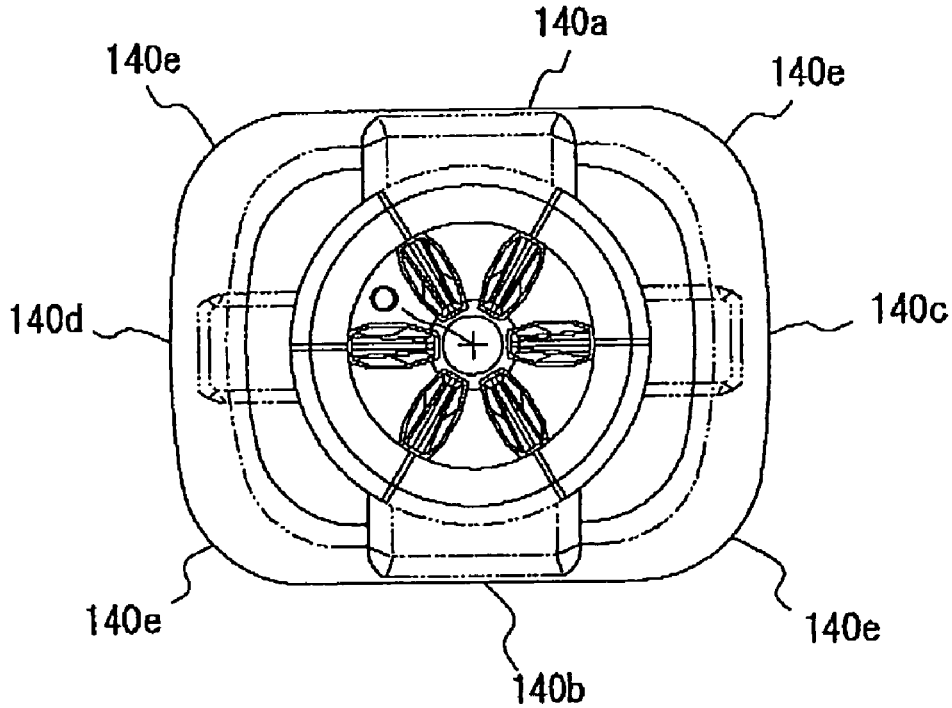
FIG. 3*b* is a bottom view of the synthetic resin bottle shown in FIG. 1.
Figure 4A:
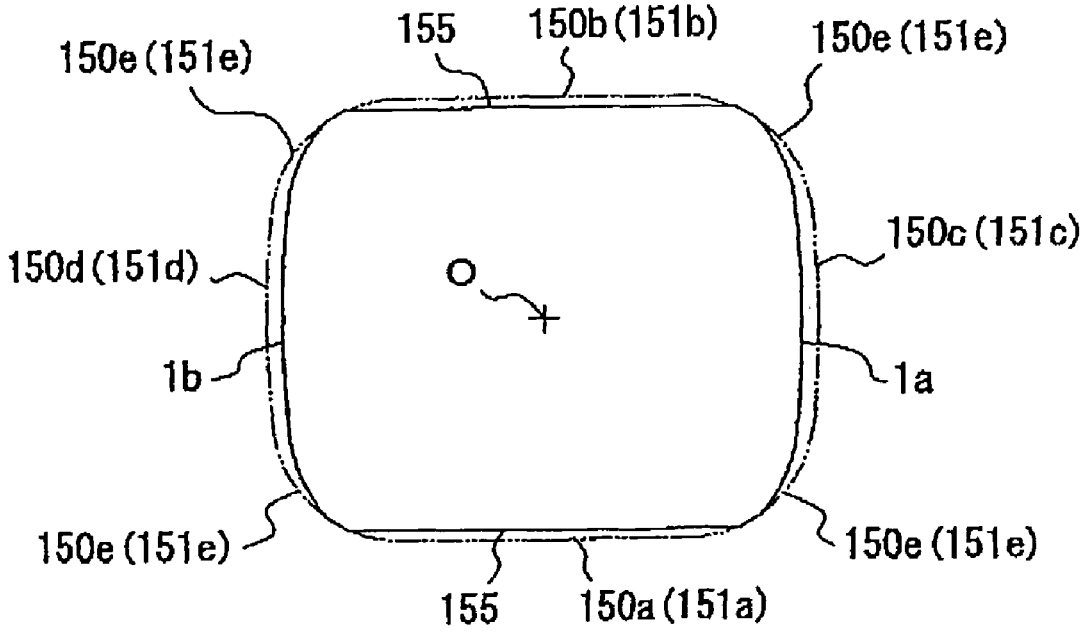
FIG. 4*a* is a cross-sectional view taken along line A-A in FIG. 1.
Figure 4B:
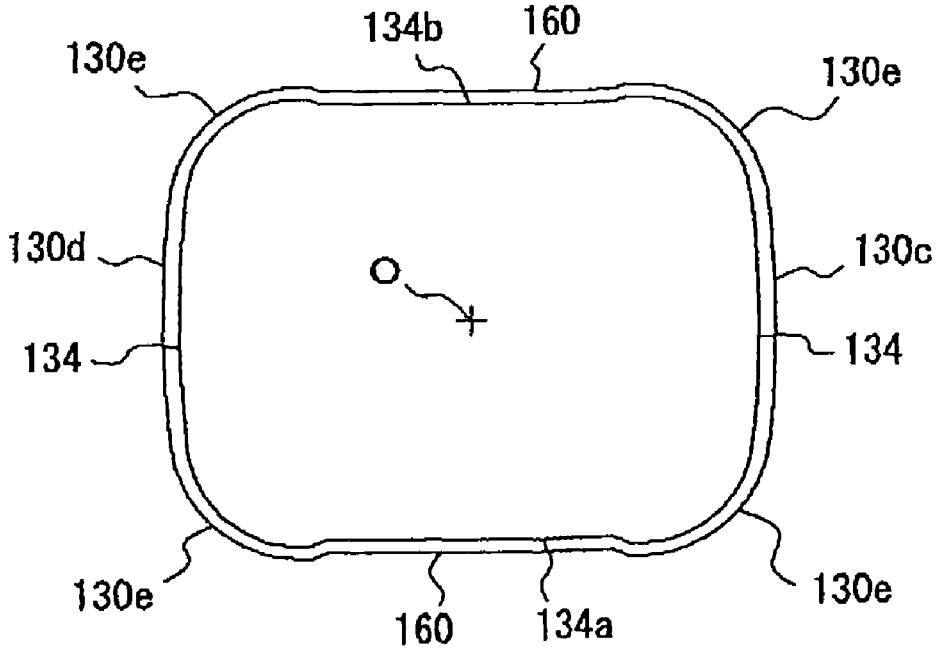
FIG. 4*b* is a cross-sectional view taken along line B-B in FIG. 1.

FIG. 1 is a front view of a synthetic resin bottle 100 according to the invention and FIG. 2 is a side view thereof. FIG. 3*a* and FIG. 3*b* are top and bottom views of the bottle 100, respectively. FIG. 4*a* and FIG. 4*b* are cross-sectional views of parts taken along lines A-A and B-B, respectively.

A bottle 100 is formed by biaxially stretch-blow molding a preform (not shown) made of PET (polyethylene terephthalate) resin. The bottle 100 has a flattened outer profile in which a mouth portion 110, a shoulder portion 120, a body portion 130 and a bottom portion 140 are integrally connected as shown in FIG. 1.

In more detail, the body portion 130, when viewed from a bottle axis O direction, has a front wall 130*a* and a back wall 130*b* as longer sides which face to each other, a left sidewall 130*c* and a right sidewall 130*d* as shorter sides which face to each other, and connecting portions 130*e* which respectively connect such walls 130*a*-130*d* by curves, as shown in FIG. 3*a*. The body portion 130 is a square column having a generally rectangular outer profile in the cross section along the circumferential direction.

Furthermore, the bottom portion 140, when viewed from the bottle axis O direction, also has a front wall 140*a* and a back wall 140*b* as longer sides which face to each other, a left sidewall 140*c* and a right sidewall 140*d* as shorter sides which face to each other, and connecting portions 140*e* which respectively connect such walls 140*a*-140*d* by curves, as shown in FIG. 3*b*. The bottom portion 140 is a square column having a generally rectangular outer profile in the cross section along the circumferential direction.

That is, when viewed from the mouth portion 110 or the bottom portion 140, the bottle 1 is a square column-like bottle having a generally rectangular shape in which the mutually facing two longer sides are connected to the mutually facing two shorter sides via curves.

The body portion 130 has an annular constricted portion 150 looping circumferentially around the bottle axis O. The constricted portion 150, when viewed from the bottle axis O direction, also has a front wall 150*a* and a back wall 150*b* as longer sides which face to each other, a left sidewall 150*c* and a right sidewall 150*d* as shorter sides which face to each other, and connecting portions 150*e* which respectively connect the walls 150*a*-150*d* by curves, as shown in FIG. 4*a* by a dashed double-dotted line. The constricted portion 150 is a square column having a generally rectangular outer profile in the cross section along the circumferential direction.

The constricted portion 150, as shown in FIG. 1 and FIG. 2, has a strip-like portion 151 looping along the circumferential direction, a slope portion 152 connected to the strip-like portion 151 and expanding outward toward the bottom portion 140 (hereafter referred to as "the bottom side of slope") and a slope portion 153 connected to the strip-like portion 151 and expanding outward toward the shoulder portion 120 (hereafter referred to as "the shoulder side of slope"). The shoulder side of slope portion 153 is integrally connected to the shoulder portion 120 via the connecting portion 154. The connecting portion 154 has an approximately-same outer diameter at the left sidewall 150*c* and the right sidewall 150*d*, as shown in FIG. 1, while the front wall and the back wall expand outward toward the shoulder portion 120, as shown in FIG. 2.

The strip-like portion 151 and the bottom side of slope 152 are provided with lateral grooves 1 and 2, respectively, extending along the circumferential direction with same length.

One lateral groove, the left lateral groove 1*a* in this embodiment, has a cross section having a curved shape symmetrical with respect to the center of the groove bottom, as shown in FIG. 1, and is arranged so that it extends from the left sidewall 150*c* through the connecting portion 150*e* and terminates before the terminal ends 1*ae* reach the front wall 150*a* and the back wall 150*b*, respectively, as shown in FIG. 4*a*. Similarly, the other lateral groove, the right lateral groove 1*b* in this embodiment, has a cross section having a curved shape symmetrical with respect to the center of the groove bottom, as shown in FIG. 1, and is arranged so that it extend from the right sidewall 150*d* through the connecting portion 150*e* and terminates before the terminal ends 1*be* reach the front wall 150*a* and the back wall 150*b*, respectively, as shown in FIG. 4*a*. That is, the left lateral groove 1*a* and the right lateral groove 1*b* extend, along the circumferential direction, to the connecting portion 150*e* on the left sidewall 150*c* and the right sidewall 150*d*, respectively, and the terminal ends 1*ae*, 1*be* of the left and right lateral grooves 1*a*, 1*b*, respectively, do not join each other and thus an intermittent portion of the grooves is formed on the front wall 150*a* and the back wall 150*b*.

On the other hand, one of the lateral grooves 2, the left lateral groove 2*a* in this embodiment, has a cross section with the groove bottom offset toward the bottom portion 140, and is arranged so that it extends from the left sidewall 150*c* through the connecting portion 150*e* and terminates before the terminal ends 2*ae* reach the front wall 150*a* and the back wall 150*b*, respectively, as shown in FIG. 1. Similarly, the other lateral groove or the right lateral groove 2*b* has a cross section with the groove bottom offset toward the bottom portion 140, and is arranged so that it extends from the right sidewall 150*d* through the connecting portion 150*e* and terminates before the terminal ends 2*be* reach the front wall 150*a* and the back wall 150*b*, respectively. That is, the left lateral groove 2*a* and the right lateral groove 2*b* extend, along the circumferential direction, to the connecting portion 150*e* at the left sidewall 150*c* and the right sidewall 150*d*, respectively, and the terminal ends 2*ae*, 2*be* of the left and right lateral grooves 2*a*, 2*b*, respectively, do not join each other and thus an intermittent portion of the grooves is formed on the front wall 150*a* and the back wall 150*b*.

According to the embodiment, the cross section of the constricted portion 150 along the circumferential direction has a polygonal outer profile and the left sidewall 150*c* and the right sidewalls 150*d* are provided with the left lateral grooves 1*a*, 2*a* and the right lateral groove 1*b*, 2*b*, respectively, extending to the connecting portions 150*e* along the circumferential direction, so that the stress concentration at the constricted portion 150 caused by the load applied along the bottle axis O is dispersed to, thereby, suppress occurrence of the buckling at the constricted portion 150.

In addition, according to the embodiment, the left and right lateral grooves 1*a*, 1*b* provided at constricted portion 150 are arranged so that the adjoining terminal ends 1*ae*, 1*be* are spaced apart and similarly the left and right lateral grooves 2*a*, 2*b* are arranged so that the adjoining terminal ends 2*ae*, 2*be* are spaced apart, and thus the lateral grooves are not annular grooves looping entire circumference of the constricted portion 150. Therefore, with the front wall 150*a* and the back wall 150*b* as origins, the left and right lateral grooves 1*a*, 1*b* and the left and right lateral grooves 2*a*, 2*b* serve as cushions, respectively, and thus secure a large allowance for flexural deformation. That is, the left and right lateral grooves 1*a*, 1*b* (2*a*, 2*b*) provided at the constricted portion 150 generates restoring force against buckling deformation by stress applied along the bottle axis O, which prevents plastic deformation of the constricted portion 150 due to buckling.

It is noted that the front wall 150*a* and the back wall 150*b* have larger surface areas than those of the left sidewall 150*c* and the right sidewall 150*d* and can elastically deform outward from the bottle axis O. Therefore, the terminal ends 1*ae*, 2*ae*, 1*be* 2*be* of the left lateral grooves 1*a*, 2*a* and the right lateral grooves 1*b*, 2*b*, respectively, may be arranged so as to, but not necessarily, reach the front wall 150*a* and the back wall 150*b*, respectively.

The terminal ends 1*ae*, 2*ae* of the left lateral grooves 1*a*, 2*a* and the terminal ends 1*be*, 2*be* of the right lateral grooves 1*b*, 2*b* may be adopted to reach the front wall 150*a* and the back wall 150*b* without joining each other. This is effective in that the load over the bottle axis O can be reduced by the left lateral grooves 1*a*, 2*a* and the right lateral grooves 1*b*, 2*b* when the load is applied in an unexpected direction.

Functional portions 155 may be provided respectively at the front wall 150*a* and the back wall 150*b* in the constricted portion 150. In the illustrated embodiment, a rectangular flat portion 155 recessed toward the bottle axis O is provided on the inner side of the bottle 1*as* the functional portion 155. The flat portion 155 partially reaches the shoulder portion 120, the connecting portion 154 and a bulging portion 131. The flat portion 155 may be embellished through printing, labeling, carving in mold or the like. The functional portion can be arranged as a gripping portion or a pressure-reduction absorbing panel.

An annular bulging portion 131 which is adjacent to the constricted portion 150 and projects outward along the circumferential direction to be the maximum outer diameter of the bottle 1 is formed on the body portion 130, as shown in FIG. 1.

Furthermore, the bulging portion 131 is provided with a supplemental lateral groove 3 which is longer than the lateral grooves 1 and 2. The supplemental lateral groove 3 has a similar arrangement as the lateral groove 1 and has a cross section having a curved shape symmetrical with respect to the center of the groove bottom, as shown in FIG. 1. One of the lateral grooves or the left lateral supplemental groove 3*a* is arranged so that it extends from the left sidewall 130*c* through the connecting portion 130*e* and terminates before the terminal ends 3*ae* reach the front wall 130*a* and the back wall 130*b*, respectively, and the other of the lateral grooves or the right lateral supplemental groove 3*b* is arranged so that it extends from the right sidewall 130*d* through the connecting portion 130*e* and terminates before the terminal ends 3*be* reach the front wall 130*a* and the back wall 130*b*, respectively. Such supplemental grooves 3 exert the same effect against the load applied along the bottle axis O as of the lateral grooves 1 and 2.

It is noted that the left lateral supplemental groove 3*a* and the right lateral supplemental groove 3*b* also exert the same effect as of the lateral grooves 1 and 2. Therefore, the terminal ends 3*ae*, 3*be* do not necessarily reach the front wall 130*a* and the back wall 130*b*, respectively.

The body portion 130 is provided with circumferential grooves 133 at an area adjacent to the bulging portion 131 and at a portion connecting with the bottom portion 140 as well as a plurality of annular grooves 134 looping circumferentially around the bottle axis O are disposed between the circumferential grooves 133.

The circumferential groove 133 has a cross section having a curved shape symmetrical with respect to the groove bottom, as shown in FIG. 1, The annular groove 134 has a groove bottom with a flat cross section, is symmetrical with respect to the groove bottom and is arranged between two circumferential grooves 133 at approximately even intervals, as shown in FIG. 1. Plurality of annular grooves 134 are formed in an identical shape.

Furthermore, the front wall 130*a* and the back wall 130*b* of the body portion 130 are provided with a pressure-reduction absorbing plane 160 extending from the area of the annular groove 134 closest to the constricted portion 150 to the area of the annular groove 134 farthest from the constricted portion 150, as shown in FIG. 1. The pressure-reduction absorbing panel 160 is located outward than the outer diameter of the annular groove 134 which intersects with the pressure-reduction absorbing panel 160, as shown in FIG. 4*b*. In addition, the pressure-reduction absorbing panel 160 is recessed radially inward at two areas, namely an area of 134*a* which intersects with the pressure-reduction absorbing panel 160 at the side of the front wall 130*a* and an area of 134*b* which intersects with the pressure-reduction absorbing panel 160 at the side of the back wall 130*b*. The bulging ratio of the areas 134*a*, 134*b* and the pressure-reduction absorbing panel 160 is preferable within a range of 10-80% relative to the annular groove 134, the front wall 130*a* and the back wall 130*b*.

The front and back walls 140*a*, 140*b* are provided with the recess 141, and the left and right sidewalls 140*c*, 140*d* are provided with the recess 142. The recesses 141 and 142 enhance rigidity of the front and back walls 140*a*, 140*b* and the left and right sidewalls 140*c*, 140*d*, respectively, and are thus effective against buckling at the bottom portion 140 caused by a load applied along the bottle axis O.

Therefore, according to the invention, it is possible to provide a synthetic resin bottle having high commercial value, which prevents plastic deformation accompanied with buckling.

Although the present invention has been described above with reference to the illustrative preferred embodiment, it is apparent that various modifications may be made without departing from the scope of the appended claims. The outer profile of the body portion 130 in the cross section along the circumferential direction can be modified appropriately according to the shape of the connecting portion 130*e*. Forming the connecting portion 130*e* from more than one wall, for example, can produce bottles having various polygonal cross section. A cross section of the constricted portion may be curved symmetrical with respect to the center of the groove bottom. It is enough that a left sidewall and a right sidewall have at least one lateral groove at the constricted portion for each.

What is claimed is:

1. A synthetic resin bottle comprising a body portion connected to a mouth portion via a shoulder portion, and at least one constricted portion provided on the body portion and looping along the circumferential direction, wherein the body portion comprises a front wall and a back wall which face each other, a left sidewall and a right sidewall which face each other, and connecting portions which respectively join the walls; the cross section of the body portion along the circumferential direction has a generally polygonal outer profile; the constricted portion comprises a strip-like portion looping along the entire circumferential direction, a bottom side slope portion connected to the strip-like portion and expanding outward toward the bottom portion, a shoulder side slope portion connected to the strip-like portion and expanding outward toward the shoulder portion, a left lateral groove extending from the left sidewall at least to the connecting portion along the circumferential direction, and a right lateral groove extending from the right sidewall at least to the connecting portion along the circumferential direction and intermittent portions formed by spacing apart adjacent terminal ends of the lateral grooves, and wherein at least one of the strip-like portion and the bottom side slope portion are provided with the lateral grooves.

2. The synthetic resin bottle according to claim 1, wherein the terminal ends of the lateral grooves reach the front wall and the back wall.

3. The synthetic resin bottle according to claim 1, wherein the body portion has a generally rectangular cross section in which the front and back walls are its longer sides, the left and right sidewalls are its shorter sides, and the connecting portions are curves.

4. The synthetic resin bottle according to claim 1, wherein both of the strip-like portion and the slope portion are provided with the lateral grooves.

5. The synthetic resin bottle according to claim 1, wherein an area adjacent to the constricted portion is provided with a supplemental lateral groove which is longer than the lateral groove.

6. The synthetic resin bottle according to claim 1, wherein the body portion is provided with a plurality of annular grooves and a pressure-reduction absorbing panel which extends between the annular groove closest to the constricted portion to the area of the annular groove farthest from the constricted portion, and that the pressure-reduction absorbing panel is located outward of the bottle than the bottom of the annular groove which intersects with the pressure-reduction absorbing panel, and that the annular grooves are recessed inward of the bottle at areas where the annular grooves intersect with the pressure-reduction absorbing panel.

7. The synthetic resin bottle according to claim 1, wherein a flat portion is provided on at least one of the front wall and the back wall in the constricted portion, and the flat portion partially reaches the shoulder portion, a connecting part and a bulging portion.

* * * * *